United States Patent [19]

Toth

[11] Patent Number: 4,887,932

[45] Date of Patent: Dec. 19, 1989

[54] INTEGRAL BUOYANCY AND BALLAST SYSTEM FOR SCUBA DIVERS

[75] Inventor: Douglas J. Toth, Huntington Beach, Calif.

[73] Assignee: Under Sea Industries, Inc., Rancho Dominguez, Calif.

[21] Appl. No.: 129,212

[22] Filed: Dec. 7, 1987

[51] Int. Cl.[4] ..... B63C 11/30

[52] U.S. Cl. ..... 405/186

[58] Field of Search ..... 405/185, 186, 187; 2/2.1 R; 224/191; 441/106, 108

[56] References Cited

U.S. PATENT DOCUMENTS

| | | | |
|---|---|---|---|
| 3,401,529 | 9/1968 | Fifield | 405/186 |
| 3,648,324 | 3/1972 | Stradella et al. | 405/186 X |
| 3,670,509 | 6/1972 | Walters | 405/186 |
| 4,000,534 | 1/1977 | Cerniway | 405/186 |

*Primary Examiner*—David H. Corbin

*Attorney, Agent, or Firm*—Leonard Tachner

[57] ABSTRACT

An integral floatation or buoyancy compensating device and weight assemblies for divers. The buoyancy compensating device provides an integral back pack which is used to support the air tank of a conventional scuba diving type. At least one and preferably two quick release weights are mechanically attached to the buoyancy compensating device usually at an integral waistband and worn around the waist similar to conventional hip style weights, but are individually releasable by a quick release mechanism from the waistband rather than normally jettisoning an entire band. The band to which the weights are attached are an integral lower extension of the buoyancy compensator or buoyancy compensating device. Weight release is simple and one handed with no band to entangle or become entrapped beneath the tank or other piece of equipment normally worn by the diver. Weight location is set about the waist near the hands when in a relaxed position. Weight release is effected by a simple grasping and squeezing action. Thus, there is no dependency on a secondary device or reaction to a remote release to release the weights. The weights are actually in-hand during the release process and free from entanglement with other gear. The weight assembly portion of the invention may also be used with a separate weight belt such as when the buoyancy compensating device is not used.

8 Claims, 4 Drawing Sheets

INTEGRAL BUOYANCY AND BALLAST SYSTEM FOR SCUBA DIVERS

BACKGROUND OF THE INVENTION

1. Field of the Invention

The present invention relates generally to scuba diving equipment and more specifically, to a system for scuba divers comprising an integrated buoyancy and ballast apparatus comprising a buoyancy compensating device and quick release weight assemblies in an integral unit.

2. Prior Art

The following U.S. patents relate to buoyancy systems for divers:

2,120,420 Topper
3,090,205 Hurwitz et al.
3,161,028 Odum et al.
3,374,636 Mason
3,670,509 Walters
3,747,139 Braly
3,877,098 Braly
4,016,616 Walters
4,054,132 Deeds
4,068,657 Kobzan
4,455,718 Finnern
4,608,940 Bulin U.S. Pat. No. 2,120,420 to Topper is directed to ballast weights for diving belts that provide a front and back ballast weight which are formed at the upper ends with hook extensions by which the weights are attached to and suspended by the bars. The ballast weight may be freed to fall away from the shoulder piece a by pulling the plunger clear of a recess and swinging a locking member upwardly about a pivot to bring a finger clear of the belt.

U.S. Pat. No. 4,608,940 to Bulin is directed to a remote weight release for a buoyancy control device. When the diver wishes to release the respective weights W1 and W2 from the buoyancy control device, he pulls a handle 82 outwardly relative to a guide channel so that the distal ends of respective cords disengage from respective flexible loops of pockets to permit the weight of the weights to urge folded sheets of material to the open disposition as is shown in FIG. 8 whereby the weights pass through the open ends of the pockets.

U.S. Pat. No. 4,016,616 to Walters is directed to a diver floatation apparatus which includes a buoyancy compensation system in the backpack over the diver's back. The pack structure is hollow and defines a compartment. The compartment contains weights of different specific gravity, such as lead shot and glass marbles. The bottom of the chamber is closed by a door which may be opened to jettison all or parts of the weights. This is similar to the disclosure in U.S. Pat. No. 3,670,509.

U.S. Pat. No. 3,090,205 to Hurwitz et al is directed to a harness pack for free diving apparatus. A tank is mounted to a harness pack and is carried on the back of the diver and is held by the bands in a cradle which is secured to the harness pack. The diver's weights are fixed to an arcuate base plate which carries a mounting pin and is removably held to a waistband by weight release levers. Each of the weight release levers is slidably mounted to the inside of the waistband through a retainer engaged within a slot. An enlarged keyhole portion of the slot engages the pin when the release lever is pulled. Thus, the weights are released by pushing the lever down to permit the pin to fall free of the enlarged portion of the slot.

U.S. Pat. No. 4,054,132 to Deeds is directed to an integrated diving system which includes a backpack, shoulder harness, waistband, weight belt, tank holder, buoyancy compensator. The shell includes weight compartments as well as water gills. The weights are retained in the compartment by a door affixed to the shell by a strap threaded through a system of slots in the shell and the door.

The following additional U.S. patents relate primarily to releasable weight assemblies:

1,094,895 Hazen
1,563,350 Field et al.
2,970,448 Di Julio
3,039,273 Swindell
3,090,205 Hurwitz et al.
3,105,359 Ellis
3,135,098 Root
3,192,723 Apperson
3,220,197 Christiansen
3,263,432 Maskell
3,401,529 Fifield
3,648,324 Stradella et al.
4,305,685 Rentfrow
4,455,718 Finnern U.S. Pat. No. 3,648,324 to Stradella et al. is directed to ballast weights and an associated belt. The diver may depress a push button inward in a direction toward the weight and the lower recess of the push button will engage onto the upper beveled/slotted portion of a clamp. The clamp then is contracted to such an extent as to disengage from the seat and permits the weight to slide out.

U.S. Pat. No. 3,039,273 to Swindell is directed to a diver's weight coupling to a belt. In this reference, a locking piece is inserted in holes from the top of the member. When the locking piece is inserted, a space exists in the recesses surrounding legs. This space is occupied by the belt whereby the belt will be held captive in the recesses by the locking piece. By removal of the locking piece, the weight is removed.

U.S. Pat. No. 3,192,723 to Apperson is directed to another diving weight. The belt is flexed to provide a generally U-shaped belt portion which is displaced edgewise relative to body comformably into a groove. Through the configuration of the groove and the conforming reception therein of a belt portion, the belt is frictionally retained in the groove when the belt is worn. Firm securement of the weight in the belt is provided by the wedging action of the belt portion in the tapering groove.

Pat. No. 2,970,448 to Di Julio is directed to another belt supported diving ballast. The weight in this reference is hooked over a belt through slots. A curved side leans against the belt which compresses the material to prevent the side movement of the belt from the originally installed position.

Pat. No. 3,401,529 to Fifield is directed to what is termed a coupling and provides for the coupling between a belt and weights. This patent is directed to a quick release weight and when securing the weight in a holder, one end of the weight is positioned against corresponding flanges and then the other flange is pulled in a direction stretching a tongue and enlargement where the weight is displaced into place and extensions become interlocked in corresponding recesses. When the weight is removed from the holder, one of the flanges is pulled away from the weight to stretch the tongue and enlargement and release the extension and the weight may be pulled out of the holder.

SUMMARY OF THE INVENTION

The present invention provides an integral floatation or buoyancy compensating device and weight assemblies. The buoyancy compensating device provides an integral back pack which is used to support the air tank of a conventional scuba diving type. At least two quick release weights are mechanically attached to the buoyancy compensating device preferrably at an integral waistband and worn around the waist similar to conventional hip style weights, but are individually releasable by a quick release mechanism from the waistband rather than normally jettisoning an entire band. The band to which the weights are attached are an integral lower extension of a buoyancy compensator or buoyancy compensating device. This type of interconnection permits the weight of the weight assemblies to be borne primarily by the buoyancy compensating device and back pack rather than by the diver's back and hips which is the case in conventional prior art scuba equipment. Conversely, the buoyancy of the buoyancy compensating device works to counter the weights directly rather than through the diver. The weights are unobstructed and easily grasped with either hand to be released. The release is simple and one handed with no band to entangle or become entrapped beneath the tank or other piece of equipment normally worn by the diver.

The system of the present invention provides improved safety over conventional waistbands. Specifically, jettisoning the weight in the present invention can be accomplished quickly and simply without the risk of entanglements which might otherwise prevent release of the weights in a conventional waistband. One highly advantageous feature of the present invention is the direct attachment of the weights to the back pack and buoyancy compensating device assembly which relieves the diver's back of the entire load normally borne by the diver in a conventional system. Because the weights are mounted on the exterior of the buoyancy compensating device and adjacent the padded waistband, the diver does not normally even feel the weights. The buoyancy compensating device is provided with the usual connector and buoyancy hose and when air is added to the buoyancy compensating device to trim the diver's buoyancy, the buoyancy compensating device acts to lift the weight through the system rather than through the diver. In conventional systems which do not have direct attachment, the buoyancy compensating device tends to lift the shoulders and the weights pull the diver down at the waist thereby bending him into a very uncomfortably U-shape. When the buoyancy compensating device is inflated on the surface, the same advantage is achieved and the buoyancy compensating device tends to lift the weights rather than the diver. Consequently, the buoyancy compensating device does not tend to ride up over the head of the diver when the diver is floating in a vertical position. Donning the system in the water is also much easier due to the ballasting of the weights floating the buoyancy compensating device and tank in a slightly reclined armchair position. Furthermore, because the weights are so easily removed from the system, transport of the ballasted system is not necessary. The weights can be easily removed or attached at any time including above the surface or even in the water if necessary.

The unique weight release system of the present invention permits quick release and reattachment of the weights to the system with one hand. Weight location is set about the waist near the hands when in a relaxed position. Consistency of weight location and positioning of attachment and release during set-up or transport, conditions the diver to automatically learn the exact weight location to effectively release them if necessary. Furthermore, ease of weight release and attachment permits easy breakdown of the components of the system for transport. The novel weight release assembly of the present invention permits weight release to be effected by a simple grasping and squeezing action. Thus, there is no dependency on a secondary device or reaction to a remote release to release the weights. The weights are actually in-hand during the release process and free from entanglement with other gear. Release of the weight may be effected independently of attitude and the effects of gravity. It is also unaffected by sand contamination and avoids unintentional release. The release mechanism is completely retained in the weight assembly as a unit. Therefore there are no loose pieces or components that can be lost. The waistband portion of the present invention maintains a consistent size before and after weight attachment and allows attachment of the weights at any time without readjustment. The weights can be manufactured inexpensively of readily available materials such as lead or lead alloy and the assembly can be assembled by simple screw fastening or snap fit means using injection molded plastic parts. The weight is durable and of thick section to be resistant to damage. The weights are designed to be set circumferentially about the waist equidistant from the diver's tank and each other for optimum distribution.

OBJECTS OF THE INVENTION

It is therefore a principal object of the present invention to provide an integral buoyancy and ballast system for scuba diving which comprises a back pack to secure the air supply tank, a buoyancy compensation device to provide floatation, and a quick release weight assembly to provide ballast, all of which can be readily and reliably disconnected from a unitary system.

It is additional object of the present invention to provide an integral ballast and buoyancy system for divers which affords greater comfort both in and out of the water by a more appropriate distribution of weight and floatation on the diver's body.

It is still an additional object of the present invention to provide an integral ballast and buoyancy system for divers which has a high degree of safety by providing the diver with the ability to easily and effectively jettison the weights with little or no risk of inadvertently obstructing the release of the weights.

It is still an additional object of the present invention to provide an integral ballast and buoyancy system for divers which affords easy breakdown, handling and transportation for the user.

It is still an additional object of the present invention to provide an integral ballast and buoyancy system for divers in which there is direct attachment of weights to a back pack and buoyancy compensating device assembly thereby relieving the diver's back of the load.

It is still an additional object of the present invention to provide a quick-release weight assembly for divers in which one hand can be used to depress a spring-loaded actuator built into the weight for separating the weight from the buoyancy compensator.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 2:
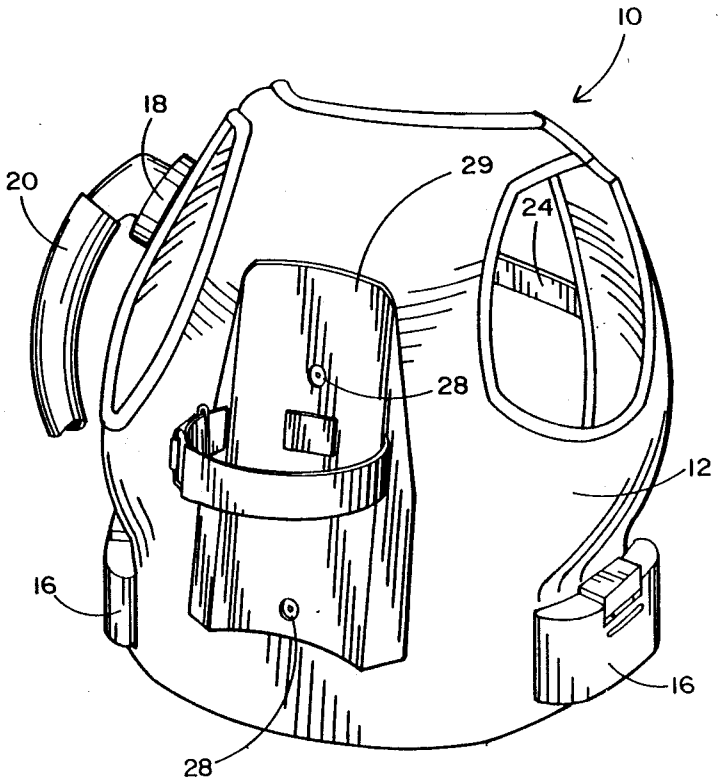
FIG. 2 is a rear isometric view of the present invention.
Figure 1:
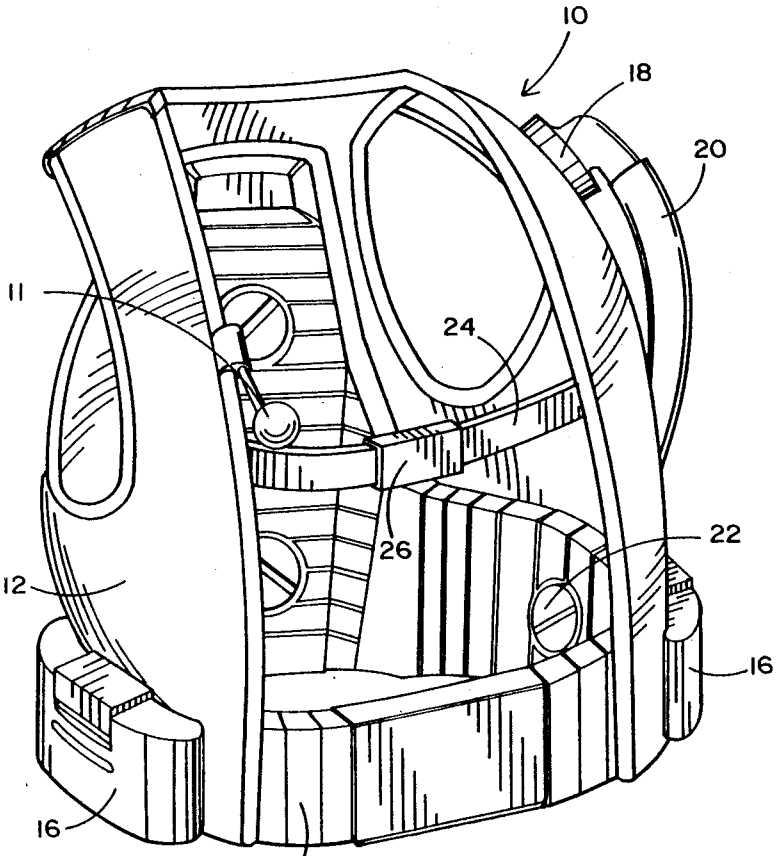
FIG. 1 is a frontal isometric view of the integral ballast and buoyancy system of the present invention.
Figure 3:
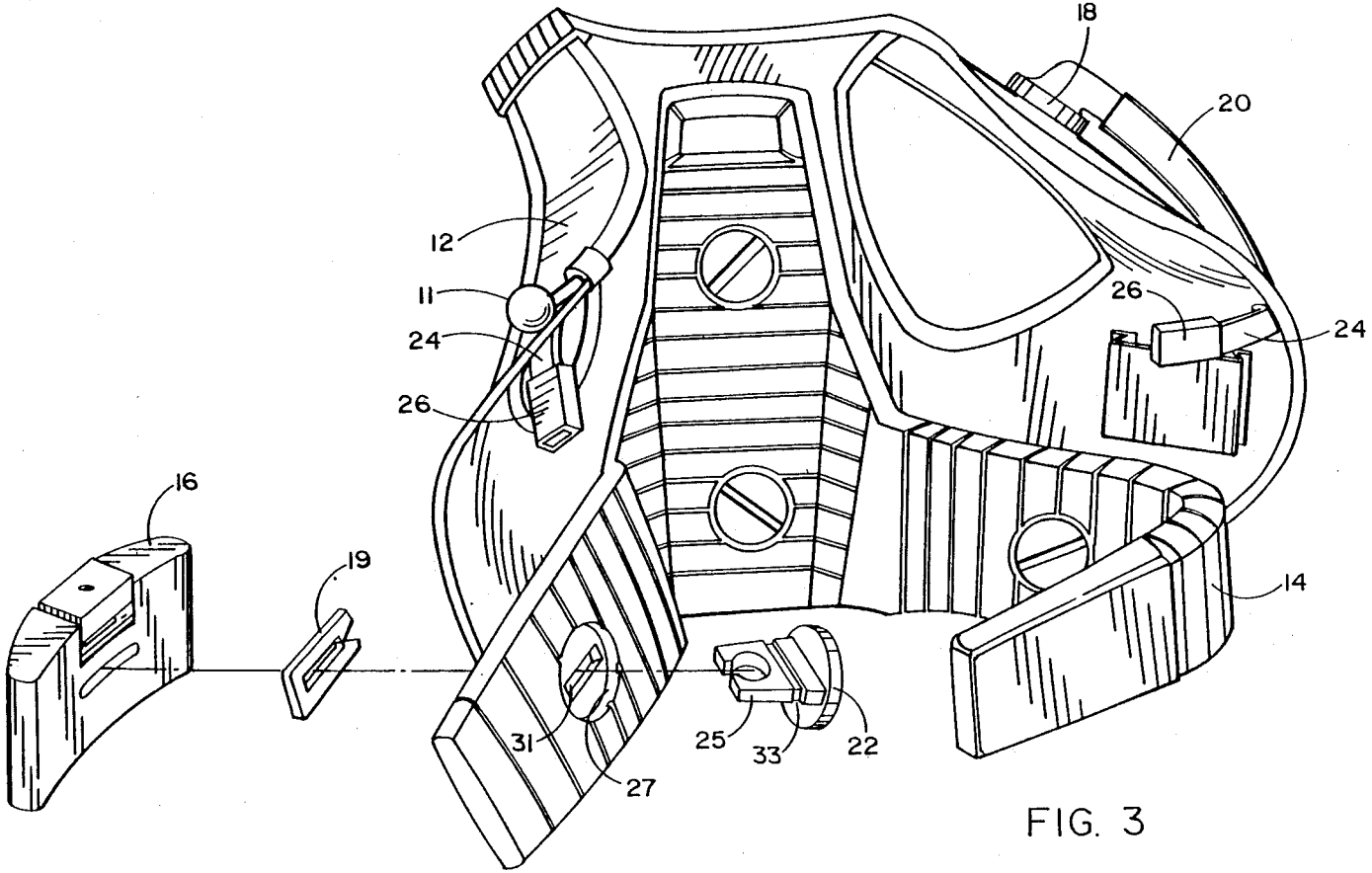
FIG. 3 is an exploded view of the system of the present invention illustrating primarily the interior surface of the integral ballast and buoyancy system thereof.

Referring first to FIGS. 1–3, it will be seen that the buoyancy and ballast system 10 of the present invention comprises a floatation or buoyancy compensating device 12 which has integral therewith a padded waistband 14 and a back pack 29. The back pack 29, waistband 14 and buoyancy compensating device 12 are all integrally interconnected to form a singular unit which may be put on or removed by the diver in a simple unitary action. A conventional air vent pull cord 11 is also shown in FIG. 1, but has no bearing on the present invention. Also included in the present invention, as shown best in FIGS. 1 and 2, are a pair of weight assemblies 16 which are integral with the waistband 14 and which are connected thereto by means of a retainer 22 which is positioned at the interior surface of waistband 14 at a suitably shaped recess 27. Retainer 22 is provided with an insert 25 which is designed to extend through the waistband 14 at aperture 31 of recess 27 and into the remaining portion of the weight assembly 16 as will be described hereinafter in more detail in conjunction with FIGS. 4–10. A clip 19 may be used to secure the retainer 22 in the waistband 14 even when the weight assembly 16 has been removed therefrom. Clip 19 is designed to engage retainer 22 in press-fit relation at an annular depression 33 seen best in FIG. 3. Weight assembly 16 may be mounted in virtually any position on buoyancy compensating device 12 including a position inverted from that shown in the drawings.

A more detailed description of the weight assembly portion of the invention and the manner in which it connects to the buoyancy compensating device 12 and waistband 14 of the invention will now be provided in conjunction with FIGS. 4–10.

Figure 4:
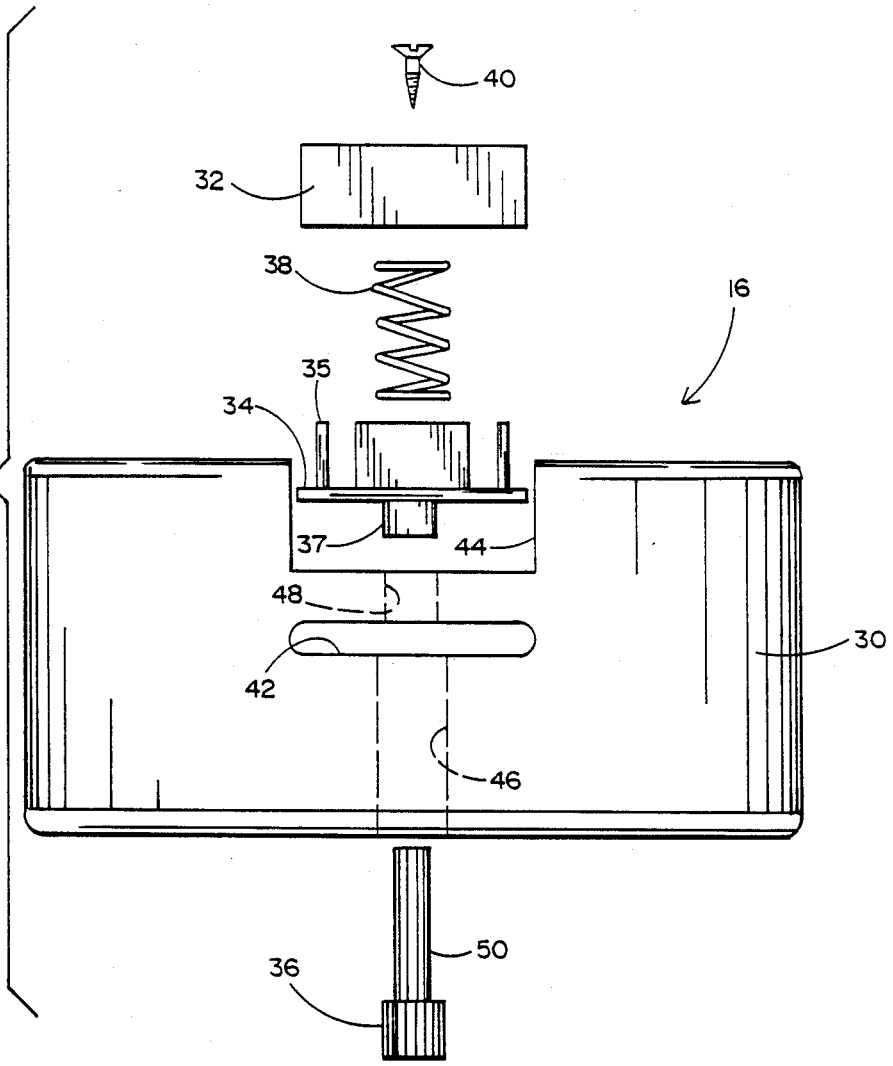
FIG. 4 is an exploded view of the weight assembly of the present invention.
Figure 5:
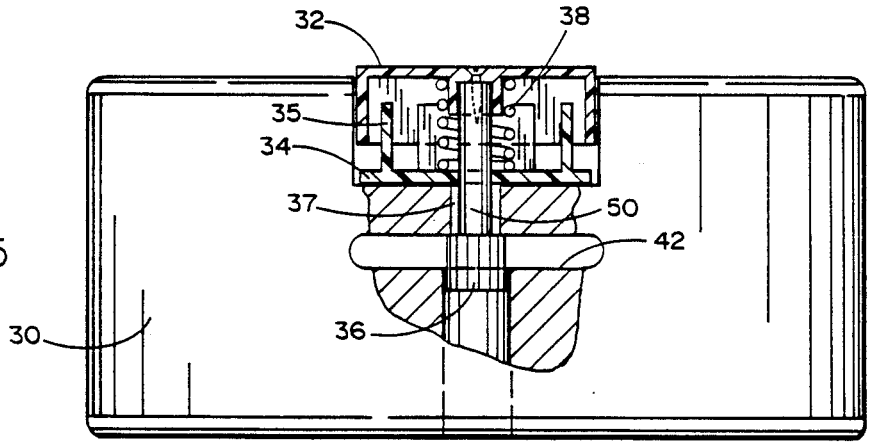
FIG. 5 is an assembled, partially cross-sectioned view of the weight assembly of the present invention.

Referring first to FIGS. 4 and 5, it will be seen that the weight assembly 16 comprises a weight 30, an actuator 32, a spring enclosure 34, a spring 38 and a ring retainer 36. Weight 30 provides a number of passages. More specifically, weight 30 provides an insert passage 42, an actuator slot 44, a ring retainer passage 46 and a shaft passage 48. The actuator 32, spring enclosure 34 and spring 38 and all mounted in the actuator slot 44 in coaxial alignment with the ring retainer 36. The ring retainer is provided with an extended shaft 50 the end of which is threaded to receive the screw 40 to provide the assembled configuration shown best in the cross-sectional view of FIG. 5. In that assembled configuration, actuator 32 and spring enclosure 34 are engaged in mutually compressive relation with the spring 38 between them. A pair of shoulders 35 on spring enclosure 34 provides a stop mechanism for depression of actuator 32. A cylinder 37 of the spring enclosure 34 engages the shaft passage 48 of weight 30. Spring 38 applies an upwardly directed force against actuator 32 thereby positioning the ring retainer 36 in the insert passage 42. However, when actuator 32 is depressed or pushed downwardly compressing spring 38, ring retainer 36 is forced further down into ring retainer passage 46 placing shaft 50, which is of narrower diameter than ring retainer 36, in alignment with insert passage 42. Thus, by selectively depressing actuator 32, the ring retainer 36 may be selectively placed in a position either in insert passage 42 or below insert passage 42 to either secure the weight 30 to the retainer 22 or permit its release therefrom.

Figure 6:
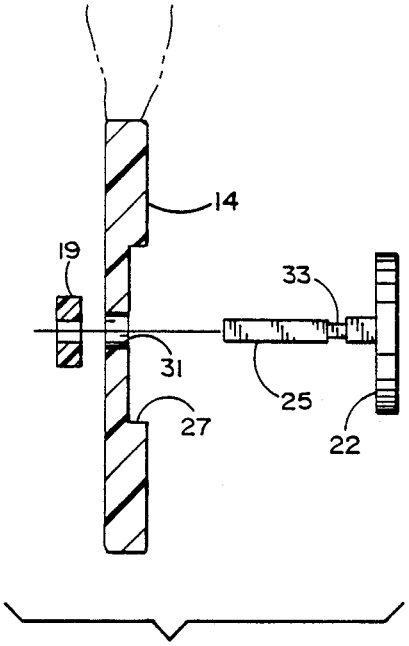
FIG. 6 is an exploded view of portions of the weight assembly of the present invention indicating the manner in which it is connected to the buoyancy compensating device portion of the invention.
Figure 7:
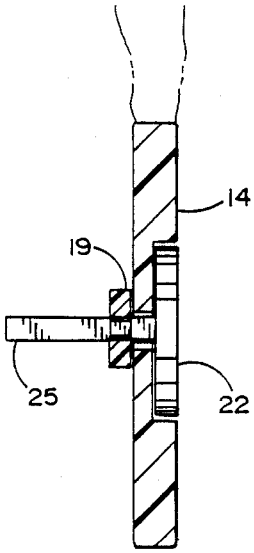
FIG. 7 is a view similar to that of FIG. 6 but illustrating the interconnection of the aforementioned portions of the invention.
Figure 8:
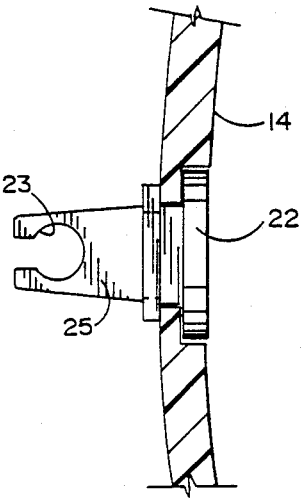
FIG. 8 is a view similar to that of FIG. 7 but showing the interconnection of the aforementioned portions of the invention from an alternative view.

Referring now to FIGS. 6, 7 and 8, it will be seen that the retainer 22 provides an insert 25 which includes a C-shaped insert ring 23. Furthermore, it will be seen that the padded waistband 14 is provided with a circular recess 27 including an elongated aperture 31 previously described in conjunction with FIG. 3. The elongated aperture 31 is designed to pass the insert 25 of retainer 22 which may be optionally secured therein by clip 19. Clip 19 engages annular depression 33 as shown in FIGS. 7 and 8. In this manner, retainer 22 is positioned within the recess 27 of band 14 for selectively supporting a weight assembly 16 thereto.

Figure 9:
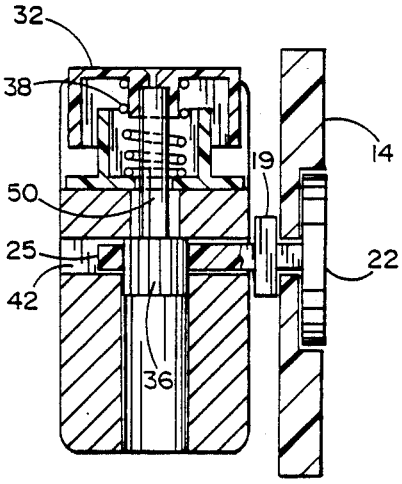
FIG. 9 is a cross-sectional side view of the weight assembly of the present invention shown connected to the buoyancy compensating device thereof with the weight assembly configured to retain the weight.
Figure 10:
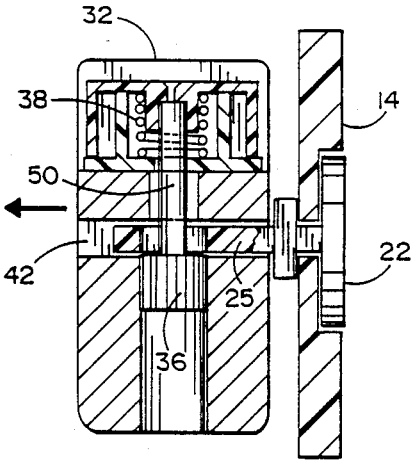
FIG. 10 is a view similar to that of FIG. 9 but illustrating the configuration of the weight assembly in preparation for removing the weight portion thereof from the buoyancy compensating device assembly.

The operation of the weight assembly 16 relative to the buoyancy compensating device 12 and the retainer 22 may be understood best by referring now to FIGS. 8, 9 and 10. In FIG. 9 it will be seen that the actuator 22 is in its raised position in which the separation between the actuator and the spring enclosure 34 is greatest due to the spring force of spring 38. In this position, the ring retainer shaft 50 is elevated to its highest position placing the ring retainer 36 in the insert passage 42 and also within the insert ring 23 of insert 25 thereby securing the weight 30 to the buoyancy compensating device 12. On the other hand, FIG. 10 illustrates the configuration of the weight assembly 16 wherein the actuator 32 has been depressed until it has hit the stops provided by shoulders 35 compressing spring 38 and repositioning ring retainer 36 below the insert passage 42. Because the shaft 50 has a diameter significantly smaller than the diameter of ring retainer 36, in this compressed condition the weight 30 may be readily removed from the insert ring 23 of insert 25 thereby permitting the diver to release the weight assembly 16. It will be noted that because of the novel design of the weight assembly 16, depression of actuator 32 and release of the weight 30 from the buoyancy compensating device 12 may be effected with only one hand on each weight. It will be seen that it is unnecessary to remove any other portion of the integral buoyancy and weight system of the present invention to remove the weights 30. Furthermore, it will be seen that there is no equipment adjacent to or in front of the waistband region and particularly in the region of the weight assembly 16 that might otherwise interfere with the release of the weights 30 therefrom.

Those having skill in the art to which the present invention pertains will understand that what has been disclosed herein comprises a novel and advantageous integral buoyancy and ballast system for scuba divers. In one embodiment, the need for a conventional weight belt is obviated by a buoyancy compensating device to which weight assemblies are directly connected such as at a waistband. However, unlike conventional weight belts, the waistband of the invention functions only to secure the buoyancy compensating device to the diver while the buoyancy compensating device supports the weight of the weight assemblies. Connecting the weight assemblies at the waistband is not a requirement of the invention. A preferred embodiment of the invention comprising a presently contemplated best mode thereof has been disclosed herein. It will be understood by those having skill in the art to which the present invention pertains that various modifications and additions may be made to the invention without departing from the scope of protection. By way of example, it will now be understood that the particular dimensions, materials, manufacturing processes and specific shapes of the various components of the invention may be varied without departing from the basic teaching of the applicant herein. By way of further example, the weight assemblies of the present invention may be connected to the buoyancy compensating device thereof at virtually any location within easy reach of the diver. Connecting the weight assemblies at the waistband is not a requirement of the invention. Consequently, all such modifications and additions are deemed to be within the scope of the present invention which is to be limited only by the claims appended hereto.

I claim:

1. An integral buoyancy and ballast apparatus primarily for use by scuba divers and comprising:

a buoyancy compensating device having means for retaining air therein to give buoyancy to a diver;

a backpack having means for securing an air supply tank thereto;

said buoyancy compensating device having means for securing at least one weight thereto to give ballast to a diver;

said buoyancy compensating device and said backpack being interconnected to each other to form an integral system;

at least one weight assembly having a weight releasably connected to said buoyancy compensating device and having means for effecting release thereof with only one hand;

said means for effecting release comprising a spring biased actuator on said weight and a retainer on said buoyancy compensating device, said retainer being retained in said weight when said actuator is in a first position and being removable from said weight when said actuator is in a second position;

said retainer being affixed to said buoyancy compensating device and comprising an insert member extending radially from said buoyancy compensating device; and wherein said weight further comprises a slot shaped to receive said insert member in intimate contact therewith;

said insert member comprising a C-shaped ring and said actuator comprising a ring retainer having an elongated shaft connected for slideable motion between said first and second positions of said actuator, said weight having a passage for receiving said ring retainer.

2. The apparatus recited in claim 1 further comprising a clip for releasably securing said retainer to said buoyancy compensating device.

3. The apparatus recited in claim 1 wherein said buoyancy compensating device comprises a waistband for securing said buoyancy compensating device to a user.

4. A ballast apparatus for use by divers and comprising:

a weight belt and at least one weight assembly having a weight releasably connected to said weight belt and having means for effecting release thereof with only one hand;

said means for effecting release comprising a spring biased actuator on said weight and a retainer on said weight belt, said retainer being retained in said weight when said actuator is in a first position and being removable from said weight when said actuator is in a second position;

said retainer being affixed to said weight belt and comprising an insert member extending radially from said weight belt, said weight further comprising a slot shaped to receive said insert member in intimate contact therewith;

said insert member comprising a C-shaped ring and wherein said actuator comprises a ring retainer having an elongated shaft connected for slideable motion between said first and second positions of said actuator, said weight having a passage for receiving said ring retainer.

5. The apparatus recited in claim 4 further comprising a clip for releasably securing said retainer to said weight belt.

6. A selectively releasable weight assembly for use by divers in conjunction with a weight belt, said assembly comprising:

a weight;

a spring-biased actuator on said weight and a retainer for attachment to said weight belt, said retainer being retained in said weight when said actuator is in a first position and being removable from said weight when said actuator is in a second position;

said retainer comprising an insert member and said weight comprising a slot shaped to receive said insert member;

said insert member comprising a C-shaped ring and said actuator comprising a ring retainer having an elongated shaft connected for slideable motion between said first and second positions of said actuator, said weight having a passage for receiving said ring retainer.

7. The assembly recited in claim 6 further comprising a clip for releasably securing said retainer to said weight belt.

8. A selectively releasable weight assembly for use by divers in conjunction with a weight belt, said assembly comprising:

a weight;

a spring-biased actuator on said weight and a retainer for attachment to said weight belt, said retainer being retained in said weight when said actuator is in a first position and being removable from said weight when said actuator is in a second position;

the direction of force for moving said actuator from said first position to said second position being substantially perpendicular to the direction of removal of said retainer from said weight, whereby release of said weight may be effected by merely applying a force to said actuator while bending one's wrist.

* * * * *